US007631403B2

(12) United States Patent
Galecki

(10) Patent No.: US 7,631,403 B2
(45) Date of Patent: Dec. 15, 2009

(54) LATCH FOR JEWELRY PIN

(76) Inventor: Eli Galecki, 1022 Cumbermeede Rd., Fort Lee, NJ (US) 07024

( * ) Notice: Subject to any disclaimer, the term of this patent is extended or adjusted under 35 U.S.C. 154(b) by 441 days.

(21) Appl. No.: 11/478,141

(22) Filed: Jun. 30, 2006

(65) Prior Publication Data

US 2007/0022584 A1 Feb. 1, 2007

Related U.S. Application Data

(60) Provisional application No. 60/702,842, filed on Jul. 28, 2005.

(51) Int. Cl.
*A44B 9/18* (2006.01)

(52) U.S. Cl. ..... 24/708.2; 24/708.1; 24/706.2

(58) Field of Classification Search ..... 24/707.5, 24/707.9, 708.1–708.3, 708.7, 710.1, 707, 24/707.2, 709.2, 709.4
See application file for complete search history.

(56) References Cited

U.S. PATENT DOCUMENTS 726,983 A * 5/1903 Pejchar ..... 24/708.9
783,922 A * 2/1905 Benedict ..... 24/708.2
938,090 A * 10/1909 Thurstans ..... 24/708.3
993,787 A * 5/1911 Morehouse ..... 24/708.2
996,639 A * 7/1911 Goldsmith ..... 24/708.1
1,015,603 A * 1/1912 Wilhjelm ..... 24/708.2
1,030,076 A * 6/1912 Goldsmith ..... 24/710.1
1,067,637 A * 7/1913 Bonde ..... 24/707.5
1,300,856 A * 4/1919 Murphy ..... 24/708.2
1,814,290 A * 7/1931 Cartier ..... 24/708.2
2,377,939 A * 6/1945 Holland ..... 24/708.9
2,493,988 A * 1/1950 Mezzadri ..... 24/708.2
3,118,206 A * 1/1964 Barnett ..... 24/708.1

* cited by examiner

*Primary Examiner*—Robert J Sandy
(74) *Attorney, Agent, or Firm*—Charles E. Temko

(57) ABSTRACT

An improved latch for spring wire supported articles of jewelry in which a wire loop is pivoted about an axis perpendicular to that of the spring wire for movement through substantially 180 degrees and engages a free end of the spring wire at substantially 90 degrees so that accidental snagging of said free end of said spring wire will not result in disengagement of the latch.

1 Claim, 2 Drawing Sheets

LATCH FOR JEWELRY PIN

RELATED INVENTION

Reference is made to my co-pending provisional application for Letters Patent, Ser. No. 60/702,842, filed Jul. 28, 2005, to which a claim of priority is made.

BACKGROUND OF THE INVENTION

This invention relates generally to the field of small articles of jewelry, normally secured to the clothing of a user by a pivotally-mounted pin held in a closing position by a latching means. More particularly, it relates to an improved latching means for maintaining the pin in closed or latched positions after engagement with the clothing of a wearer. Devices of this general type are known in the art, and the invention lies in specific details of the construction which will provide improved ease of installation of the article of jewelry, and a latching function which is far more positive than has been available in the prior art.

It is known in the art to provide a pin of spring wire typically mounted at one edge of the article of jewelry, with a simple hook-like retaining member adjacent an opposite edge, the free end of the wire spring being selectively positioned in engagement with the free end of the hook-like member. This construction has been used for a relatively long period of time, and is not without utility. However, on occasion, the free end of the spring wire accidentally engages with the garment of the wearer to result in the disengagement of the free end of the spring wire, and subsequent loss of the article of jewelry.

It is also known to provide a circular latch with a moveable member which obscures the opening which permits insertion of a loop end of an opposite end of a necklace. Such construction is principally employed to secure the ends of an elongated flexible article of jewelry, such as a necklace, and does not lend itself to anchoring a rectilinear spring wire. A positive action on the part of the user is required to disengage the free end of the spring wire. To this end, the latching means includes a pivotally-mounted loop member rotatable about an axis perpendicular to the axis of the spring wire.

BRIEF DESCRIPTION OF THE DRAWINGS

In the drawing, to which reference will be made in the specification.

DETAILED DESCRIPTION OF THE DISCLOSED EMBODIMENTS

Figure 1:
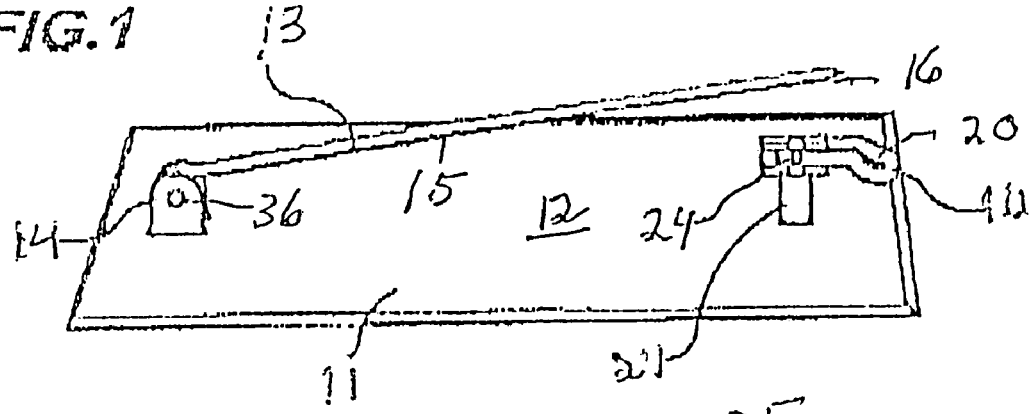
FIG. 1 is a perspective view of the first embodiment of the invention showing a latching means in open condition.

In accordance with the first embodiment, the device, generally indicated by reference character 10 is illustrated in FIG. 1 in mounted condition upon a planar base (11) of an article of jewelry having a rear surface (12). The device includes a known spring wire element (13) mounted at one end thereof upon a pivotal base (14), and including an elongated segment (15) terminating in a sharpened tip (16).

At an opposite edge of the base (11), a catch element (20) includes a base (21) which is soldered or otherwise attached to the planar base (11) having a pin (24) pivotally supporting a wire loop (25) for rotation about substantially 180 degrees of movement. It includes a central portion (17) which engages the free end of the spring wire element (12).

FIG. 1 illustrates the latch in fully open condition just prior to engagement with the free end of the spring wire.

Figure 2:
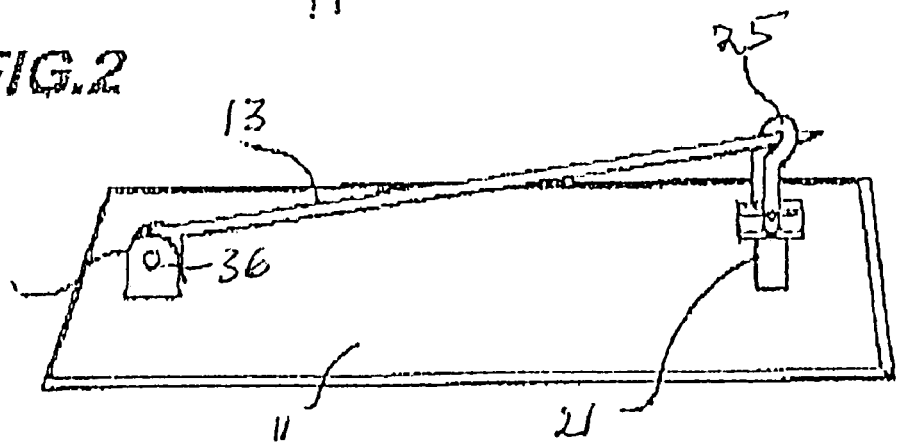
FIG. 2 is a similar perspective view showing the latching means in intermediate position.

FIG. 2 illustrates an intermediate position of the wire loop which may occur should the free end of the spring wire become snagged with a fold of clothing of the wearer. The end of the spring wire is partially dislodged, but in relatively secure position.

Figure 3:
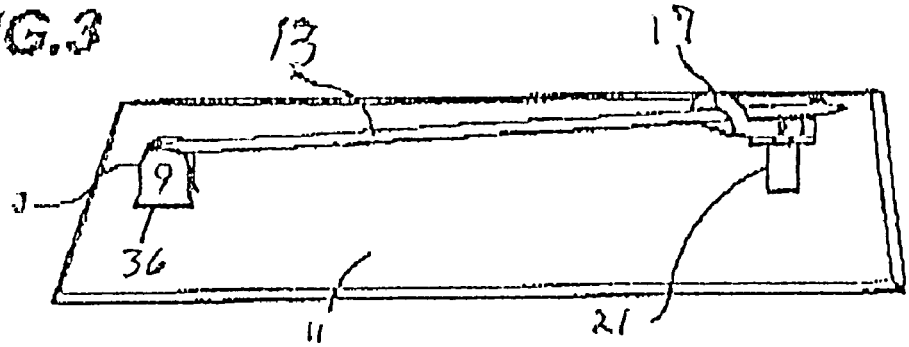
FIG. 3 is a similar perspective view showing the latching means in fully engaged condition.
Figure 8A:
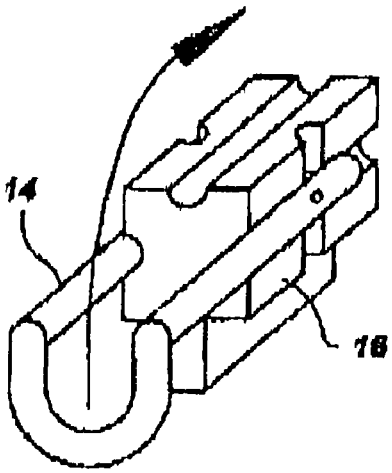
FIG. 8A is an enlarged perspective view of the first embodiment in open condition.
Figure 8B:
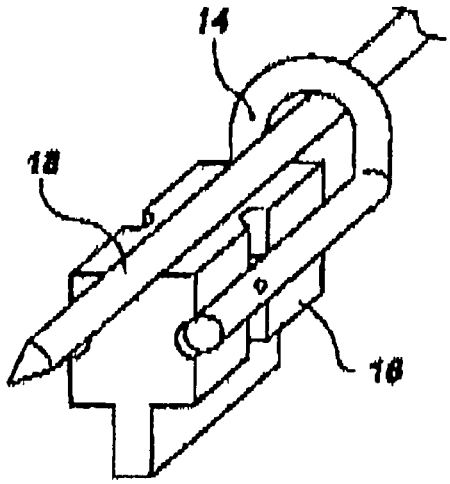
FIG. 8B is a similar perspective view showing the latching means in fully engaged condition.

FIG. 3 illustrates the latched mechanism in fully engaged condition which will occur after the article of jewelry has been engaged with the clothing of the wearer, and the loop (25) manually moved to fully engaged condition. This movement will be fully understood by a comparison of FIGS. 8 and 8A.

Figure 7:
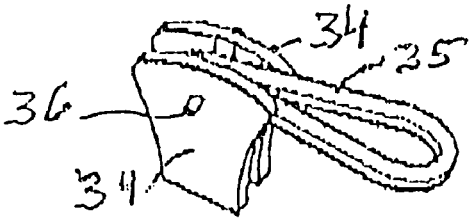
FIG. 7 is a perspective view of the latching means illustrated in FIG. 4.
Figure 7A:
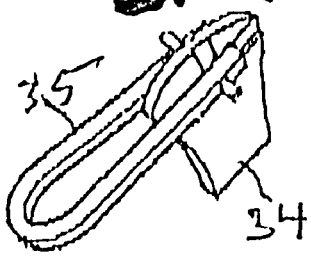
FIG. 7A is a perspective view shoring a second alternate form of latching means.
Figure 4:
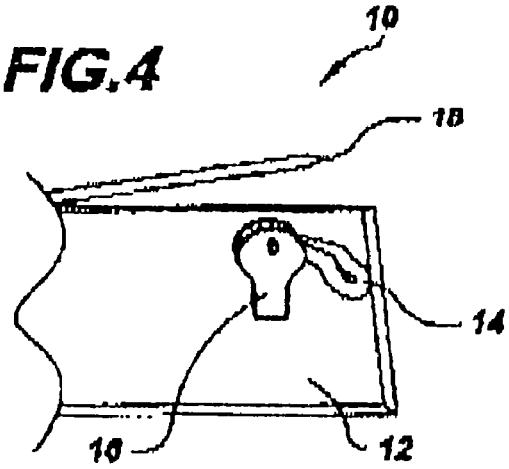
FIG. 4 is a fragmentary perspective view showing an alternate form of the embodiment in engaged condition.
Figure 5:
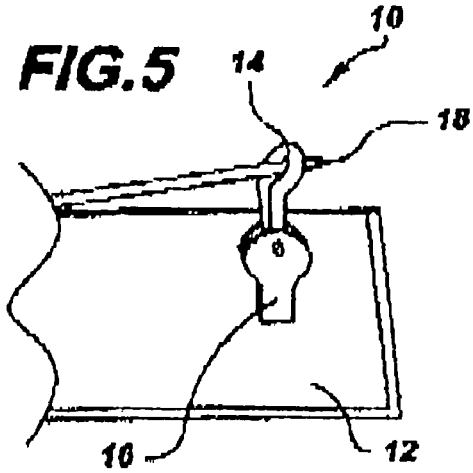
FIG. 5 is a fragmentary perspective view of the alternate form in partially open condition.
Figure 6:
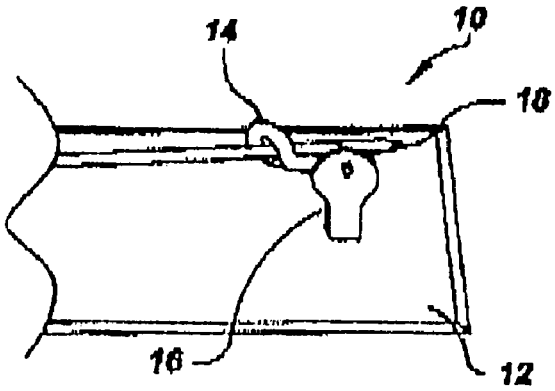
FIG. 6 is a similar perspective view showing a fully engaged condition.

In the alternate form of the embodiment illustrated in FIGS. 4-7, the latching means is formed of a pair of stampings (34) and the loop (35) is supported by the pin (36). A further modification illustrated in FIG. 7A uses only a single stamping.

It may thus be seen that I have invented a novel and highly useful improvement in latching means for spring wire type engagement of articles of jewelry upon the clothing of a wearer which precludes accidental opening of the latching means, and which requires manual manipulation to open the latching means once it has been closed. The possibility of loss of the article of jewelry due to accidental snagging of the free end of the spring wire is eliminated and should accidental snagging occur the latching means cannot become disengaged.

I wish it to be understood that I do not consider the invention to be limited to the precise details of the structure illustrated and described in the specification, for obvious modifications will occur to those skilled in the art to which the invention pertains.

I claim:

1. In a spring wire supported article of jewelry, including a spring wire pivotally mounted at one end thereof and a latching means selectively engaging said spring wire at an area adjacent a free end thereof; the improvement comprising: said latching means including a wire-like pivotally mounted loop member having a medially located spring wire engaging portion, said loop member being mounted for rotation about an axis substantially perpendicular to that of said spring wire; said member being mounted for rotation through substantially 180 degrees, and in engaged condition with said spring wire contacts said spring wire at a point located distally from said free end thereof to expose said free end to possible snagging with an engaged garment, whereupon the occurrence of snagging said free end will cause rotation of said loop member up to ninety degrees rotational movement without disengaging said spring wire from said loop member.

* * * * *